US006715810B2

(12) United States Patent
Borg

(10) Patent No.: US 6,715,810 B2
(45) Date of Patent: Apr. 6, 2004

(54) THREE BOTTLE CARRIER

(75) Inventor: James C. Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 0 days.

(21) Appl. No.: 10/238,193

(22) Filed: Sep. 9, 2002

(65) Prior Publication Data

US 2004/0046406 A1 Mar. 11, 2004

(51) Int. Cl.[7] ..... B65D 71/00

(52) U.S. Cl. ..... 294/87.2; 294/159; 206/151; 206/161

(58) Field of Search ..... 294/27.1, 31.2, 294/87.2, 87.28, 137, 159; 206/145, 147–149, 151, 159, 161, 427; 215/396; D9/344

(56) References Cited

U.S. PATENT DOCUMENTS

| | | | | |
|---|---|---|---|---|
| 2,865,669 A | * | 12/1958 | Linthicum | 294/87.2 |
| 3,888,348 A | * | 6/1975 | Frey | 206/427 |
| 4,093,295 A | | 6/1978 | Erickson | |
| 4,235,468 A | | 11/1980 | Erickson | |
| 5,188,413 A | * | 2/1993 | Nathan | 294/87.2 |
| 5,707,096 A | * | 1/1998 | Gregory | 294/87.2 |
| 5,735,562 A | * | 4/1998 | Borg | 294/87.2 |
| 6,129,397 A | | 10/2000 | Borg | |

FOREIGN PATENT DOCUMENTS

| | | | |
|---|---|---|---|
| AT | 222603 | * 11/1957 | 294/87.2 |
| DE | 2 144 334 | * 3/1973 | 294/87.2 |

* cited by examiner

*Primary Examiner*—Dean J. Kramer
(74) *Attorney, Agent, or Firm*—Chernoff, Vilhauer, McClung & Stnezel, LLP

(57) ABSTRACT

An integrally molded carrier for carrying three containers by their necks includes a substantially planar web having three nodes and defining three annular support rings. Annular neck-engaging flanges integral with the web are arranged around the inside of the support rings for releasably engaging the necks of containers. The centers of the support rings are situated in the web such that they correspond to the three corners of a triangle.

8 Claims, 3 Drawing Sheets

THREE BOTTLE CARRIER

BACKGROUND OF THE INVENTION

Multiple bottle carriers for holding and carrying bottles or jugs by their necks are well known. A common type of commercially available carrier is fabricated from thin gauge sheets of plastic. The thin planar sheet is die-cut to provide holes for engaging the necks of the containers and holes for grasping the carrier, and is thermo-formed into a three-dimensional shape to provide structural integrity to the carrier. There are several problems with this carrier. First, the thermo-formed plastic sheet shrouds the container, obscuring visibility of the product and product labels. Second, the thin gauge of the plastic material makes the carrier uncomfortable to carry.

An integrally molded carrier for carrying multiple containers by their necks is disclosed in commonly owned U.S. Pat. No. 6,129,397. The carrier disclosed therein is designed to carry six large bottles, typically one-gallon plastic jugs containing a liquid such as milk, fruit juice or water. While such products are sold in bulk in packs of six, it is advantageous from a pricing standpoint for retailers to sell 64 ounce or half-gallon bottles three to a package.

Carrying handles for three bottles, however, are awkward and difficult to use. An example of such a carrier is shown in U.S. Pat. No. 4,093,295, which discloses an in-line design bottle carrier capable of carrying three bottles by their necks by means of three uniformly spaced split collars mounted within a frame interconnected by a single row of longitudinally extending rigid bars. The carrier features two loops on the outside of the necks of the bottles which must be pulled up and grasped by the user. These handles tend to stick up above the necks of the bottles, making the bottle/carrier combination difficult to ship. The 295 carrier is also difficult to apply to groups of three bottles with automated equipment. In addition the in-line design of the 295 carrier makes the lifting of three half-gallon bottles awkward.

BRIEF SUMMARY OF THE INVENTION

The present invention provides an integrally molded carrier for carrying multiple containers by their necks and includes a substantially planar web having three nodes defining three annular supports. A flexible annular neck-engaging flange integral with the web is arranged within each annular support for releasably engaging the necks of containers. The centers of the annular supports correspond to the three corners of a triangle, preferably a right triangle.

In one embodiment, the web has three branches including a medial branch and a pair of lateral branches extending from each side of the medial branch so as to form a substantially T-shaped web structure. The web may include scalloped edges adjacent the medial branch for providing a comfortable gripping handle for the carrier.

In a second embodiment, the web is substantially triangular in shape with the sides of the triangle being inwardly radiused, and includes an arcuate opening which, together with the web, forms a handle.

The geometry of both web designs provides a balanced bottle carrier that enables three bottles to be lifted by hand and easily carried. With the web's triangle geometry, the three bottles are balanced relative to the gripping handle so that their weight is distributed evenly.

DETAILED DESCRIPTION OF PREFERRED EMBODIMENTS

Figure 1:
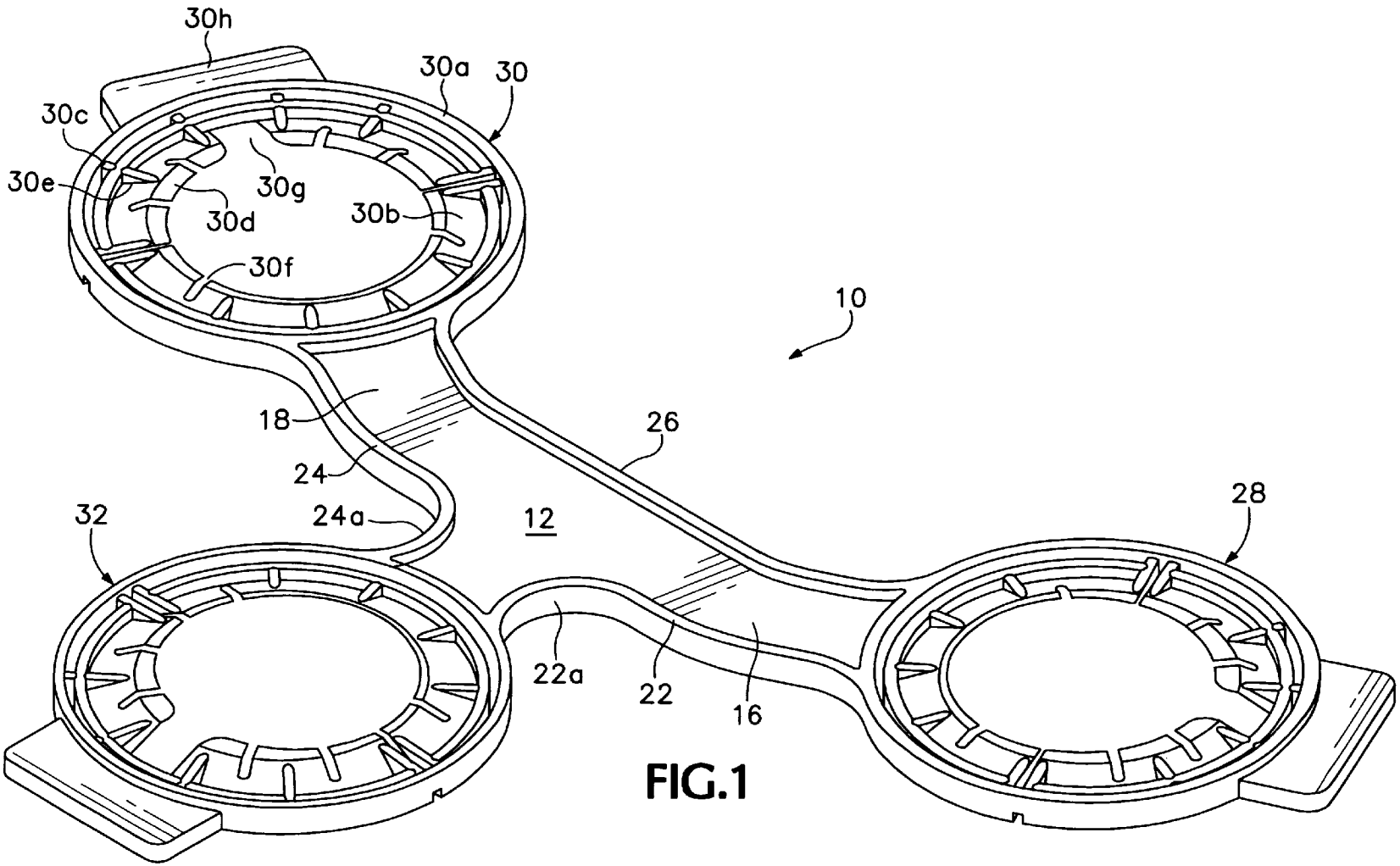
FIG. 1 is a perspective top view of one exemplary embodiment of the invention.
Figure 2:
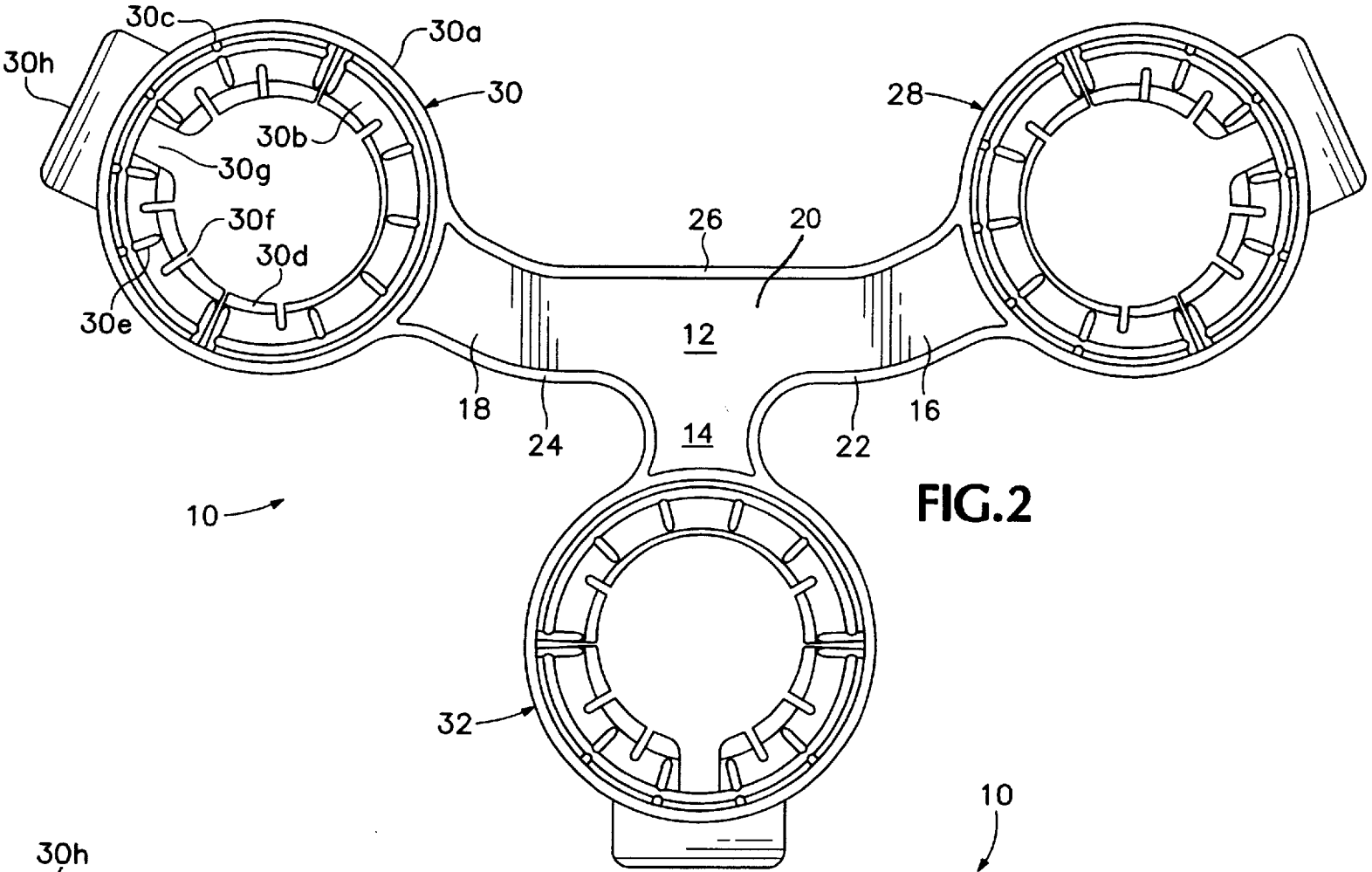
FIG. 2 is a plan view of the carrier of FIG. 1.
Figure 3:
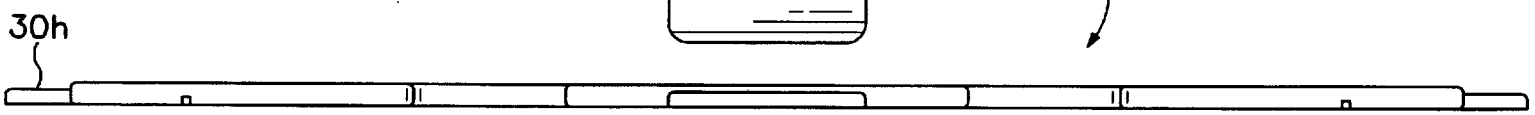
FIG. 3 is a front elevational view of the carrier of FIG. 1.

Referring to the drawings, wherein like numerals generally refer to the same elements, there is shown in FIGS. 1–3 a bottle carrier 10 for carrying three bottles that includes a substantially planar web 12 having three nodes preferably formed from a flexible material such as plastic. Web 12 has three branches: a shorter medial branch 14 and a pair of laterally extending longer branches 16 and 18 which join medial branch 14 so as to form a T-shaped structure. Branches 16 and 18 are preferably canted slightly at an angle from medial branch 14. Web 12 includes an inner portion 20 which is continuous and flat. Support ridges 22, 24 and 26 are formed on the peripheral edges of the three branches to provide structural rigidity. Support ridges 22 and 24 are radiused so as to create scalloped portions 22*a* and 24*a* along medial web branch 14.

Each of the branches 14, 16 and 18 terminate in nodes having identical flexible annular neck-engaging structures 28, 30 and 32 that are integral with web 12. Because the neck-engaging structures are identical, for simplicity, details of their structure will be limited to a single such structure, i.e., neck-engaging structure 30.

Neck-engaging structure 30 is provided with a circumferential ridge 30*a* to provide structural rigidity and with annular flange 30*b*. Annular flange 30*b* is flexible for ease in placing over and removing the same from a bottle neck, and is joined to circumferential ridge 30*a* by radial ribs 30*c*. Annular flange 30*b* is frusto-conically shaped so as to flex in an upward direction when the bottle carrier is pushed in a downward direction over the necks of the bottles and then to bear at an upward angle against the weight of the bottles when the carrier is lifted. Annular flange 30*b* also has inner edge portions 30*d* that are substantially flat. The flat portions of annular flanges 30*b* make it easier to engage a bottle neck with the annular flange and also make it easier to disengage the carrier when pry tab 30*h* is lifted. Annular flange 30*b* is also provided with sets of reinforcing ribs 30*e* that extend in a generally radial direction and sets of relief slots 30*f* also extend radially, permitting the annular flanges to flex when the necks of bottles are either engaged or disengaged.

Annular neck-engaging structures 28, 30 and 32 are preferably arranged so that their centers, when joined by imaginary lines, form the corners of a triangle, preferably substantially a right triangle. This geometry provides balance for the three bottles held by the carrier. When balanced against each other in this fashion, even heavy half-gallon bottles are easy to carry when using the web 12 as a handle.

Pry tab 30*h* is useful for disengaging the annular neck-engaging structure from the necks of the bottles. Adjacent pry tab 30*h* on the inside of support ridge 30*a* is an open space 30*g*. In other words, annular flanges 30*b* do not complete a full circle inside the support ribs but instead a space is left to further facilitate their removal from the necks of the bottles held by the carrier. The flanges still have the structural rigidity necessary to support the weight of the bottles because the flanges are shaped frusto-conically extending in an upward direction and are structurally reinforced by the radial support ridges 30*e*.

Figure 4:
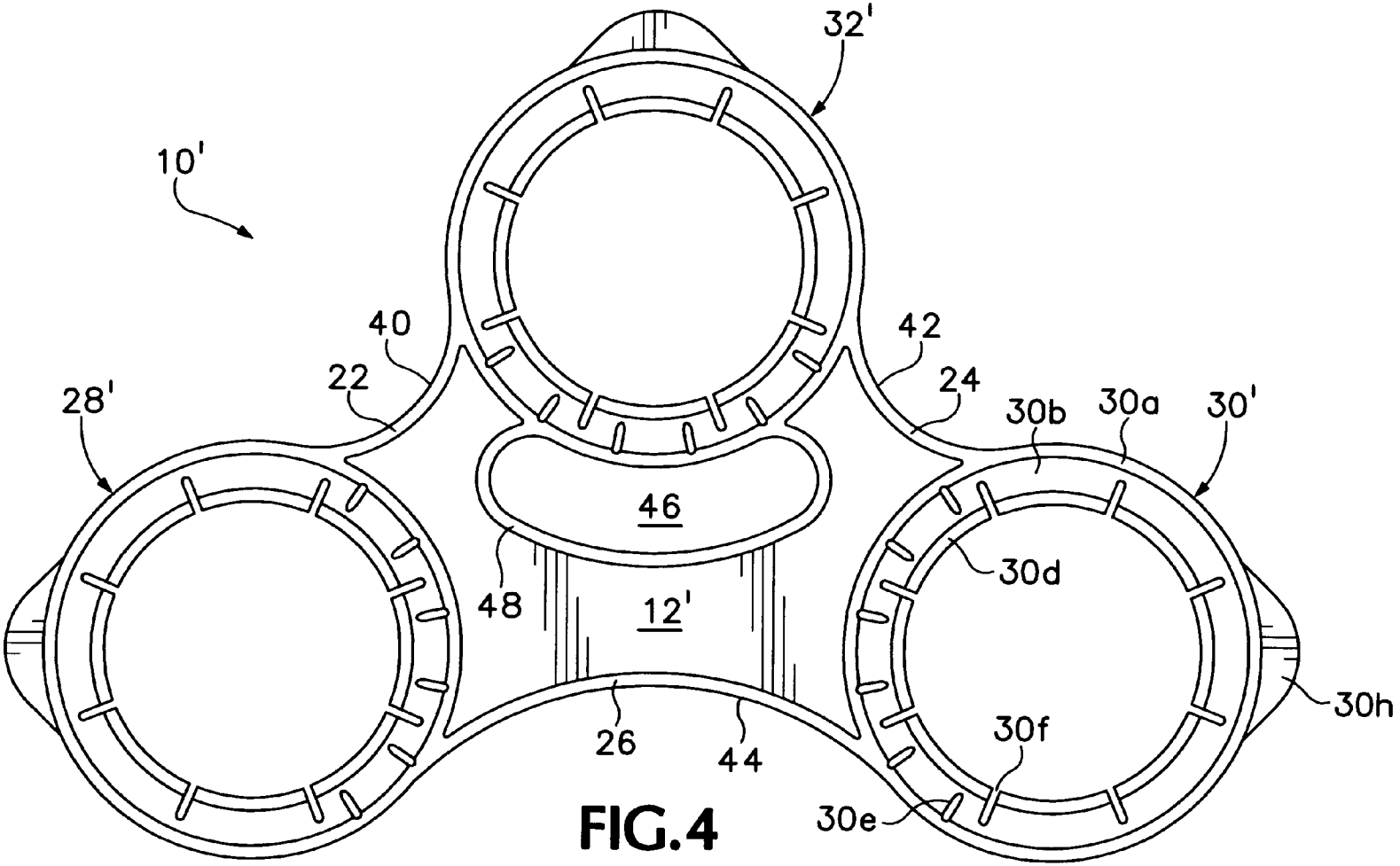
FIG. 4 is a plan view of a second exemplary embodiment of the invention.

Referring to FIG. 4, there is shown a second embodiment of the invention comprising a bottle carrier 10' having three nodes that includes a web 12', the central portion of which is generally triangular in shape with inwardly radiused sides 40, 42 and 44. Each of the radiused sides are provided with support ridges 22, 24 and 26. An arcuate opening 46 in web 12' is provided adjacent one of the three nodes to provide, in cooperation with the web 12', a handle for the carrier 10'. Arcuate opening 46 is also provided with a support ridge 48 around its periphery.

The three nodes of carrier 10' are each provided with identical annular neck-engaging structures 28', 30'and 32' having similar but not identical construction to the neck-engaging structures 28, 30 and 32 of carrier 10. Each neck-engaging structure is provided with a circumferential ridge 30*a*, an annular flange 30*b* and slots 30*f*; however, the reinforcing ribs 30*e* are provided only on the inner portion of annular flange 30*b*, there is no open space 30*g* nor are there any radial ribs 30*c*.

Although the carrier web is preferably arranged in the shape of a right triangle, it does not have to be shaped in a right triangle to function properly. Any triangular shape will provide the benefits of the invention as long as the bottles held by the laterally disposed flanges are substantially evenly balanced relative to the medial branch of the web. Thus triangular shapes other than right triangles may be employed. Other types of neck-engaging flanges may work as well. For example, flat flanges, not conically shaped, may have enough structural rigidity to grasp and hold the necks of bottles. Nor is it necessary for the embodiment shown in FIGS. 1–3 that the flanges be set apart from the annular supporting ribs by radial ribs; the web and the flanges may be integral as shown for the embodiment in FIG. 4 if the web material is strong enough. A preferred material of construction is flexible polyolefin, more preferably high density polyethylene and most preferably recyclable high density polyetheylene.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An integrally molded carrier for carrying multiple containers by their necks, comprising a substantially planar web comprising a medial branch and two longer lateral branches, said web having three nodes defining three annular supports with each annular support having a center and a flexible annular flange for releasably engaging the necks of the containers, wherein the centers of the annular supports correspond to three corners of a triangle and wherein the central portion of said web is substantially T-shaped and wherein said annular flange is suspended on radial ribs extending inwardly of said annular support and wherein said lateral branches are canted at an angle relative to said medial branch.

2. An integrally molded carrier for carrying multiple containers by their necks, comprising a substantially planar web having three nodes defining three annular supports with each annular support having a center and a flexible annular flange for releasably engaging the necks of the containers, wherein the centers of the annular supports correspond to three corners of a triangle and wherein the central portion of said web is substantially triangular with radiused sides and wherein said web includes a handle comprising a single arcuate opening in said web that is immediately adjacent one of said annular supports.

3. The carrier of claim 1 or 2 wherein said triangle is substantially a right triangle.

4. The carrier of claim 1 or 2 wherein said annular flange comprises a frusto-conical portion oriented upwardly.

5. The carrier of claim 4 wherein said annular flange further includes substantially flat inner edge portions.

6. The carrier of claim 1 or 2 made of a polyolefin.

7. The carrier of claim 6 wherein said polyolefin is recyclable high density polyethylene.

8. The carrier of claim 2 wherein said radiused sides are inwardly radiused.

* * * * *